United States Patent [19]

Charky

[11] Patent Number: 5,058,235

[45] Date of Patent: Oct. 22, 1991

[54] MOBILE VACUUM TRASH COLLECTOR

[76] Inventor: Gabriel Charky, 2214 Girouard Avenue, Montreal, Quebec, Canada, H4A 3C3

[21] Appl. No.: 437,159

[22] Filed: Nov. 16, 1989

Related U.S. Application Data

[63] Continuation-in-part of Ser. No. 92,718, Aug. 25, 1987, abandoned.

[30] Foreign Application Priority Data

Aug. 27, 1986 [CA] Canada ..... 516976

[51] Int. Cl.[5] ..... A47L 9/00

[52] U.S. Cl. ..... 15/340.1; 15/352; 15/354; 15/347

[58] Field of Search ..... 15/340.1, 347, 352, 15/327.6, 354, 361, 414

[56] References Cited

U.S. PATENT DOCUMENTS

| | | | |
|---|---|---|---|
| 2,652,902 | 9/1953 | Sheahan | 15/327.6 X |
| 2,663,894 | 12/1953 | Elliotte | 15/414 X |
| 2,878,508 | 3/1959 | Sedgwick et al. | 15/340.1 X |
| 3,052,908 | 9/1962 | Daneman | 15/354 X |
| 3,150,404 | 9/1964 | Johnson | 15/354 X |
| 3,343,199 | 9/1967 | Nolte | 15/352 X |
| 3,406,424 | 10/1968 | Rush | 15/354 X |
| 3,451,495 | 6/1969 | Bayless et al. | 15/340.2 X |
| 3,903,565 | 9/1975 | Hicks | 15/340.1 X |
| 3,984,893 | 10/1976 | Ashley | 15/340.1 X |
| 4,010,015 | 3/1977 | Brown | 15/340.1 X |
| 4,019,219 | 4/1977 | Willenborg | 15/340.1 X |
| 4,095,398 | 6/1978 | Aumann et al. | 15/340.1 X |
| 4,310,998 | 1/1982 | Cuba | 15/340.1 X |
| 4,433,532 | 2/1984 | McCunn | 15/340.1 X |
| 4,535,501 | 8/1985 | Hollowell et al. | 15/340.1 X |

FOREIGN PATENT DOCUMENTS

| | | | |
|---|---|---|---|
| 203581 | 10/1983 | German Democratic Rep. | 15/340.1 |

*Primary Examiner*—Harvey C. Hornsby
*Assistant Examiner*—Stephen F. Gerrity
*Attorney, Agent, or Firm*—Sim & McBurney

[57] ABSTRACT

A mobile vacuum trash collector comprised of a motorized cart, a frame connected rearwardly fo the cart, a bin mounted on the frame, a lid removably connected to the bin and a flexible hose connected to the lid at one end and having a nozzle at the other end. The hose is held via a rigid supporting arm above an operator's head and is maneuverable by the operator using a telescopic arm which interconnects an intermediate portion of the hose via the arm and the nozzle. A vacuum motor is mounted at the bottom of the bin for drawing airborne trash through the hose and downwardly into the bin. An air permeable bag is suspended in the bin for collecting the trash, the air being drawn downwardly and out of the bin via an exhaust port. Because suction is provided continuously downwardly through the bin, large quantities of debris are sucked into the bag and compressed or compacted. Furthermore, because the motor is mounted at the bottom of the bin, the entire apparatus has a low center of gravity and is very stable when moving over inclines and curbs.

32 Claims, 5 Drawing Sheets

MOBILE VACUUM TRASH COLLECTOR

CROSS-REFERENCE TO RELATED APPLICATIONS

This is a substitute application of U.S. Pat. application No. 260,388 filed Oct. 20, 1988 (now abandoned), which is a continuation-in-part of U.S. Pat. application Ser. No. 092,718 filed Aug. 25, 1987 (now abandoned).

FIELD OF THE INVENTION

This invention relates in general to trash collecting devices, and more particularly to a mobile vacuum trash collecting device useful for cleaning debris from roadways, sidewalks and parkland.

DESCRIPTION OF THE RELATED ART

In an effort to maintain a clean urban environment, various regional municipalities have employed personnel and equipment to collect trash, such as discarded bottles, cans, paper containers, etc., from their parks and streets.

One prior art device functions as a motorized sweeper for scattering debris from principal thoroughfares, such as sidewalks. The prior art device does not actually collect any trash, thereby requiring manual collection using picks, brooms and shovels, etc., and attendant man-hour costs. Motorized sweepers also typically exhibit poor maneuverability for negotiating obstacles, and cannot be driven over grassy surfaces, such as found in parks.

In an effort to overcome the disadvantages associated with manual trash picking and motorized sweeping, another prior art device was developed to collect trash and debris by means of a mobile vacuum trash collector. This prior art device is described in Canadian patent No. 949,707, issued June 25, 1974 to Hollowell, and entitled "Vacuum Trash Collector".

The Hollowell device comprises a pivoted cylindrical bin mounted to a frame connected to a motorized cart, such as a conventional golf cart. A retractable lid for the bin is connected to the frame via a complex spring loaded arrangement, and is surmounted by a vacuum blower. A flexible hose is supported over an operator's head by a resilient leaf spring extending from the frame, and one end of the hose is connected tengentially to the lid while the other end is connected to the nozzle.

In operation, the vacuum blower of Hollowell draws airborne debris through the flexible hose, into the lid, and upwardly toward a rotating baffle. The lid is of frustoconical shape and acts as a plenum chamber for swirling the airborne debris after its tangential introduction thereto via the hose. The air is drawn upwardly and out of the blower through an exhaust port.

A shaft of the vacuum blower extends vertically downward into the lid for driving the rotating baffle. The baffle deflects debris from being drawn upwardly into the blower, thereby preventing the vacuum blower from becoming choked or clogged. The baffle throws the larger debris centrifugally against the inside of the lid, maintaining the swirling action and grinding smaller debris into tiny particles which pass through the blower and are collected by a filter bag connected to the exhaust port.

Eventually, the heavier items of swirling debris settle downwardly into the bin as a result of gravitational force, and are collected in a large plastic bag, such as an industrial garbage bag.

As a result of the opposing forces of upwardly directed suction on the one hand, and downwardly directed gravity on the other, the Hollowell device suffers from the disadvantage that the trash is loosely collected in the bag. Accordingly, the operator is required to either frequently empty the bag, or periodically manually compress or compact the trash to allow additional trash to be collected.

More importantly, it has been found that certain articles such as plastic bags or large sheets of paper tend to cling to the rotating baffle due to the upward suction which, in response, typically chokes or clogs the vacuum blower. The operator is then required to stop the vehicle, open the lid, disentangle and then remove the plastic bag etc. before recomencing normal operation.

In fact, it has been discovered that the upward suction provided by the Hollowell device imposes a practical limit to the amount of vacuum pressure that his device is capable of delivering without clogging the baffle and blower, as discussed above. For instance, it has been found that the amount of vacuum pressure required to lift empty beer bottles, etc., using the Hollowell device, causes the lighter items already collected within the bin to be sucked upwardly, thereby entangling the baffle and choking the blower.

In addition, as a result of the vacuum blower being mounted on the lid, the center of gravity of the device is high, tending to make the cart unstable and liable to toppling over when travelling on an incline or over curbs. Also, the operator is subjected to continuous, loud, and conceivably deafening engine noise emanating from the vacuum blower mounted directly behind his or her head.

SUMMARY OF THE INVENTION

According to the present invention, a mobile vacuum trash collecting device is provided having a blower dispose in the bottom of the bin, for drawing airborne debris through the flexible hose and the length of the bin. An air permeable bag is suspended in the bin for collecting the debris while the air is sucked therethrough for discharge via an exhaust port. The air permeable bag can be made for instance from jute, fibrous plastic, or other suitable porous material such as fibrous polypropylene.

Because the vacuum blower is located at the bottom of the bin, as opposed to being mounted on the lid as in Hollowell, the air and airborne debris are sucked downward toward the bottom of the bin. The air permeable bag provides a large filtration surface such that large quantities of debris are sucked into the bag and compressed or compacted as a result of the continuous downward force. Hence, a great deal of trash can be collected within a single bag without requiring intermittent manual compaction, as in the Hollowell device.

The device of the present invention is characterized by a low center of gravity, making the cart more stable, and less likely to topple over than the Hollowell device. In addition, the operator using the device of the present invention is not exposed to ear-level vacuum blower noise.

Furthermore, the lid according to the present invention may be easily lifted to allow the bin to be tilted to an emptying position, in contrast with the Hollowell device which utilizes a complex arrangement of pivot, counterbalancing spring, and bracket to urge the heavy and cumbersome lid with blower upwardly for tilting the bin.

Most importantly, as a result of creating a continuous downward force of suction, the device embodying the present invention is capable of generating much greater vacuum pressure than Hollowell, without clogging the blower. Thus, the device of the present invention can be utilized to collect heavy objects such as beer bottles, etc. Also, flimsy articles such as plastic bags, etc., may be collected without the risk of choking the blower since the articles are sucked downwardly, directly into the air permeable bag which, as discussed above, provides a larger filtration surface than the baffle in the Hollowell device.

BRIEF DESCRIPTION OF THE DRAWINGS

These and other advantages of the invention will be better understood with reference to the detailed description below in conjunction with the following drawings, in which.

DESCRIPTION OF THE PREFERRED EMBODIMENTS

Figure 1:
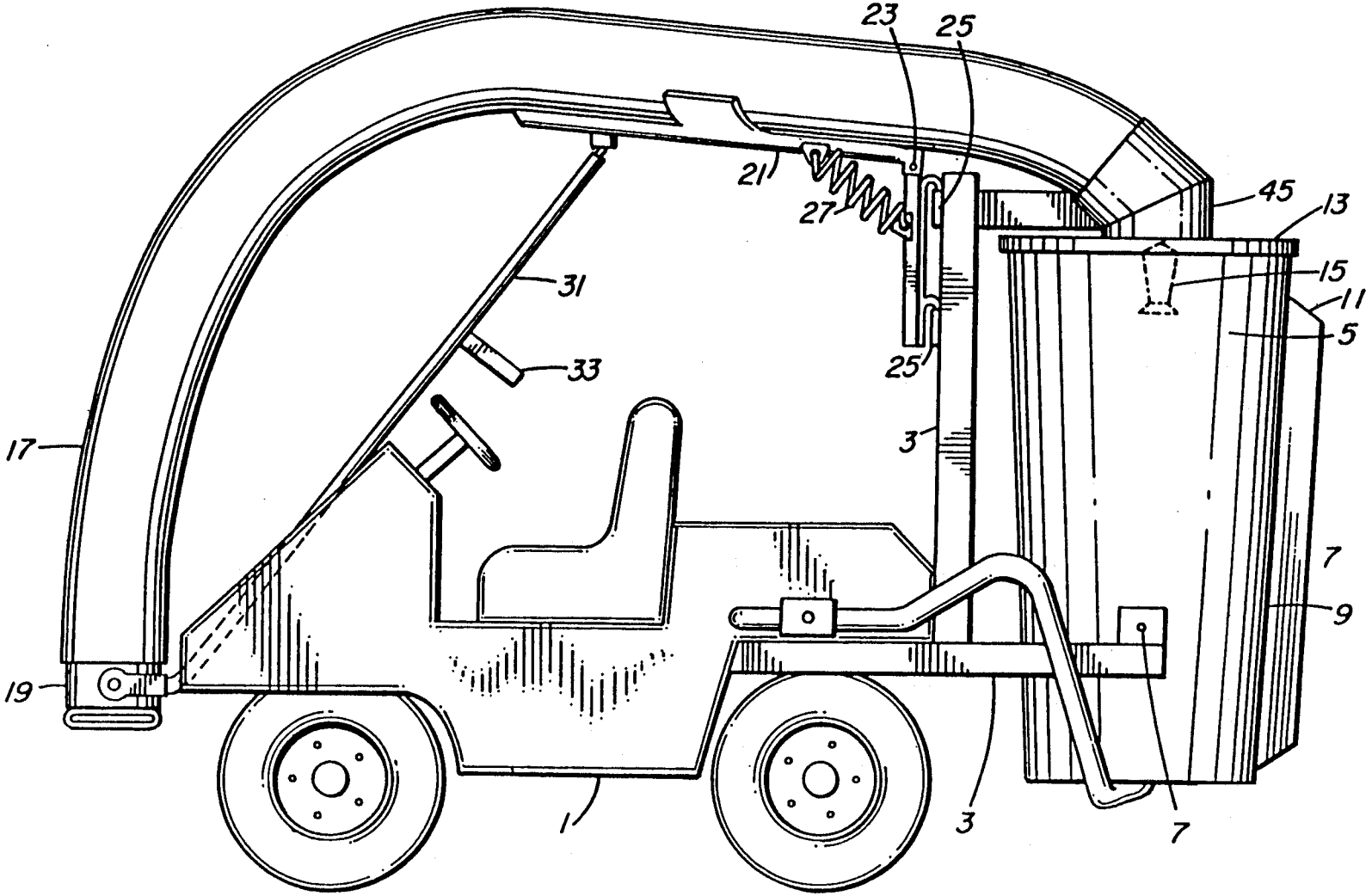
FIG. 1 is a side elevation view of a mobile vacuum trash collecting device in accordance with the present invention.

With reference to FIG. 1, a mobile vacuum trash collecting device is illustrated comprising a motorized cart 1, such as a small gas powered tractor, or other vehicle, such as the golf cart of Hollowell. A metal frame 3 is bolted securely to the cart 1, and a trash collecting bin 5 is pivotally mounted at 7 to the from 3. An exhaust stack 9 directs air from the bottom of the bin to an outlet 11.

A lid 13 is removably mounted to the top of the bin 5 via a pair of clips 15 disposed on either side of the bin. A flexible hose 17 extends vertically from the center of the lid 13, forming an arc over the operator's head and having a nozzle 19 proximate the ground at a remote end thereof. The hose 17 is supported over the operator's head by a rigid support arm 21 pivoted to the frame 3 at 23 for vertical movement, and at 25 for sideways movement. The arm 21 is resiliently supported from the frame 3 by a coiled spring 27 which is preferably adjustable to raise or lower the vertical equilibrium position of the hose.

A telescoping arm 31 connects an intermediate portion of the hose 17 via the support arm 21 to the nozzle 19, and a handle 33 is disposed thereon for allowing the operator to maneuver the nozzle to various positions along the ground and around the cart 1.

In operation, the cart 1 is driven by an operator who maneuvers the nozzle 19 via the handle 33 and telescoping arm 31 to pick up debris such as discarded paper, bottles, cans, etc., from sidewalks, lawns, roads, and parks, etc. As discussed above the low center of gravity allows the cart 1 to be driven along inclines such as hills or over curbs, without substantial risk of toppling over.

Once the internal air permeable bag (see FIG. 2) is full, the cart 1 is stopped and the operator disengages clips 15, allowing the lid 13 (with hose 17 attached) to be easily lifted. The bin 5 is then tilted to a trash emptying position for emptying the bag.

A filter, such as a vacuum cleaner bag, may optionally be connected across the outlet 11, for collecting airborne dust and other particulate matter not entrapped within the bin 5, in order to prevent dust clouds from spewing out of the exhaust outlet 11.

Figure 2:
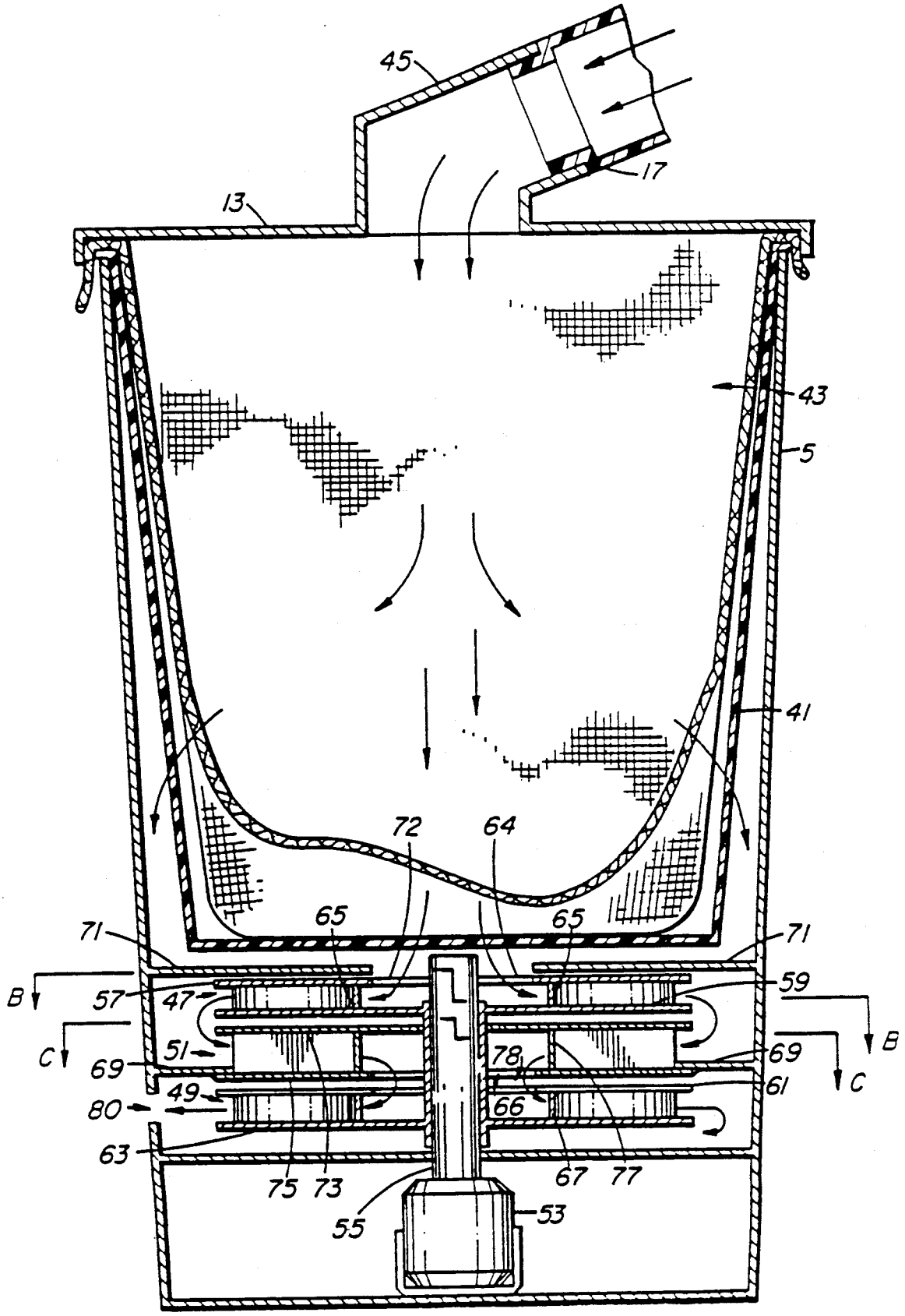
FIG. 2 is a cross sectional view of the bin taken along the line A—A of FIG. 1, including u vacuum blower mounted at the bottom thereof.

Referring to FIG. 2, the inside of bin 5 is shown in greater detail comprising a perforated holder 41 , fabricated from grid iron etc., for supporting an air permeable bag 43 within the bin. A sleeve 45 extends from the lid 13 and is adapted to fit over the end of the hose 17. A vacuum blower is disposed at the bottom of the bin and is comprised of d pair of rotating fans 47 and 49, and a stationary air guide 51, all disposed in stacking arrangement over a motor 53, and surrounding a central rotating axle or shaft 55.

Motor 53 can be hydraulically or electrically operated (or other), causing rotation of the shaft 55 and fans 47 and 49 connected thereto, resulting in suction or negative pressure within the bin 5, for drawing trash therein through the hose 17.

Figure 3:
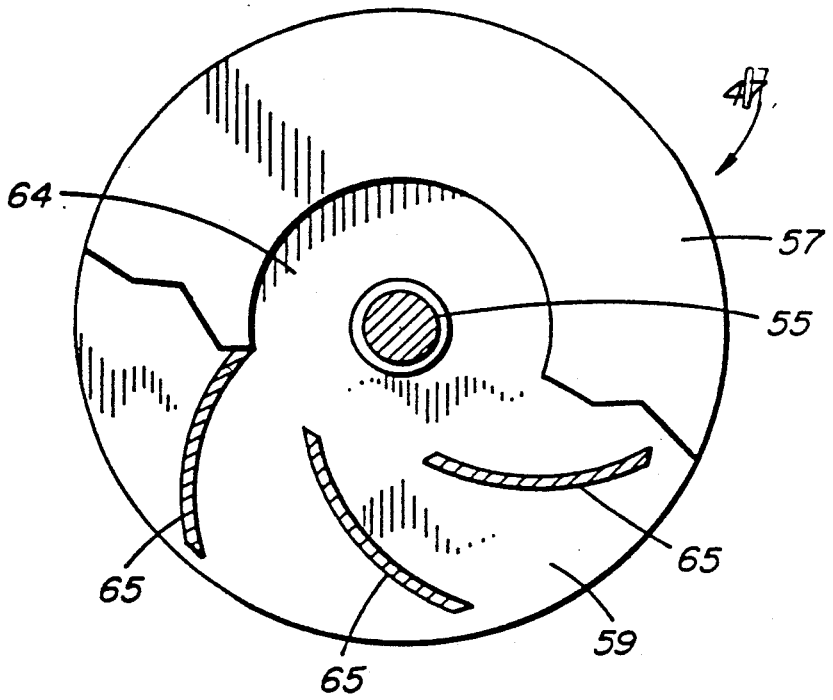
FIG. 3 is a partial cross sectional view of a centrifugal fan used in the vacuum blower, taken along the line B—B of FIG. 2.

With reference to FIGS. 2 and 3, the fans 47 and 49 are shown as preferably being centrifugal fans, each comprised of top and bottom circular discs (57,59 and 61,63) and a plurality of curved fins (65 and 67), sandwiched by the discs and forming a nautilus pattern when viewed from above. The topmost disc (57 and 61) of each fan has a centrally disposed circular aperture (64 and 66) therein for drawing air from the bin 5 into the fans.

As the fans 47 and. 49 rotate, air is drawn centrifugally outward by the rotation of the fins 65 and 67, from center to the periphery thereof. Air drawn to the periphery of the upper fan 47 is received and rammed to the center of the stationary air guide 51, as discussed in greater detail below with reference to FIG. 4.

Anular seals or washers 69 and 71 ensure that air drawn into the vacuum blower does not escape therefrom, other than through the exhaust outlet. The seal 71 is located above the upper fan 47 and has a centrally disposed aperture 72 therein, through which the air passes from the bin to the inlet aperture 64 of upper fan 47.

Figure 4:
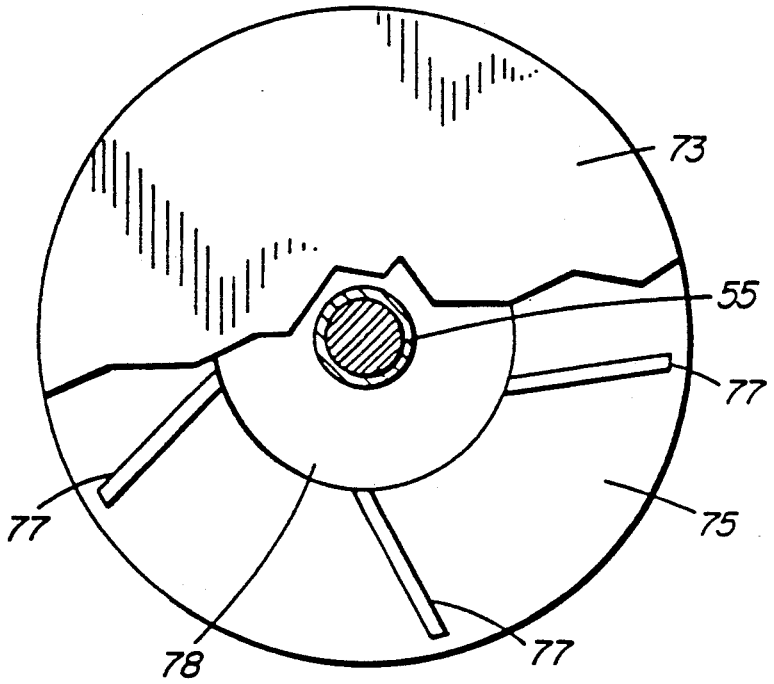
FIG. 4 is a partial cross sectional view of a stationary air guide used in the vacuum blower, taken along the line C—C of FIG. 2.

With reference to FIGS. 2 and 4, air guide 51 is illustrated comprised of top and bottom circular discs 73 and 75 and straight fins 77 for directing the outwardly drawn air at the periphery of fan 47 toward the center of the air guide. There bottom disc 75 has a centrally disposed circular aperture 78, similar to the aforementioned apertures 72, 64 and 66, for directing the airflow at the center of the airguide toward the aperture 66 to be received by the lower fan 49.

Fan 49 increases the static pressure through the bin 5 and draws the air from the central aperture 66 to the periphery, as discussed above with reference to fan 47. The air forced out of fan 49 passes through an outlet 80 at the bottom of the bin and into the exhaust stack 9, FIG. 1.

In summary, the straight through suction implemented according to the present invention results in a high degree of compaction of trash as well as highly efficient performance. The air permeable bag 43 traps and filters debris drawn into the bin such that the vacuum blower does not become blocked or clogged in the event high suction power is used, for collecting bottles, etc. As a matter of fact, as greater suction is applied according to the present device, greater compaction and efficient performance are obtained. As discussed above, a further important feature of the present invention is a high degree of vehicle stability coupled with less ear level noise than prior art devices.

A person understanding the present invention may conceive of other embodiments or variations therein.

For example, the lid 13 can be permanently attached to the bin 5, and a door or other opening can be provided in the side of the bin for trash removal.

Also, while the device of the present invention has been described in terms of the bin 5 and frame 3 being mounted directly on the cart 1, an alternative would be to mount the frame on a pair of wheels and pull the frame behind the cart via a ball and socket hitch. In this way, the frame could be disconnected in order to use the cart on its own for other functions.

As a further alternative, the lid may be rigidly connected to the frame, and the bin can be connected thereto via a pair of slotted pivots. Upon releasing the clips 15, the bin 5 would drop in the slotted pivots under the force of gravity, to a position downwardly and away from stationary lid 13, for tilting to the trash emptying position.

All such embodiments and variations are believed to be within the sphere and scope of the invention as defined by the claims appended hereto.

As an alternative to resiliently supporting the arm 21 from the frame 3 by means of coiled spring 27 (FIG. 1), power assisted apparatus may be provided for maneuvering the support arm 21.

It has been found that manual maneuvering of the support arm 21 by means of telescoping arm 31 and handle 33 can result in unnecessary muscle strain for the operator of a mobile vacuum trash collector. In particular, it has been found that the force of suction at the hose inlet 19 can result in the inlet becoming stuck to the ground requiring substantial physical force by the operator to unstick the hose inlet 19 from the ground, sidewalk, road, etc.

According to the preferred embodiment, mobile cart 1 is provided with a three position switch 30 mounted on the handle 33. An electrical cord 32 extends in spiral fashion around telescoping arm 31 from the switch 30 along supporting arm 21 to a solenoid 34 supported on the frame 3. The electrical cord is secured to the support arm 21 and frame 3 by means of resilient metallic clips, etc. The solenoid valve 34 receives high pressure hydraulic fluid (e.g. oil) from a hydraulic pump 36 connected to a drive shaft (not shown) or other rotating component of the mobile cart 1.

For example, according to the preferred embodiment, the mobile cart 1 is a hydrostatic vehicle including a gasoline engine turning a drive shaft connected to a pair of in-line pumps, the first being a hydrostatic pump for providing traction to the vehicle wheels, and the second being hydraulic pump 36 33 for pumping oil at approximately 1500 pounds per square inch through hoses 28*a* and 28*b* via solenoid valve 34. The oil flows through hoses 28*a* and 28*b* in one of two directions for either extending or retracting a piston incorporated within hydraulic cylinder 27*a*, for raising or lowering the support arm.

Figure 6:
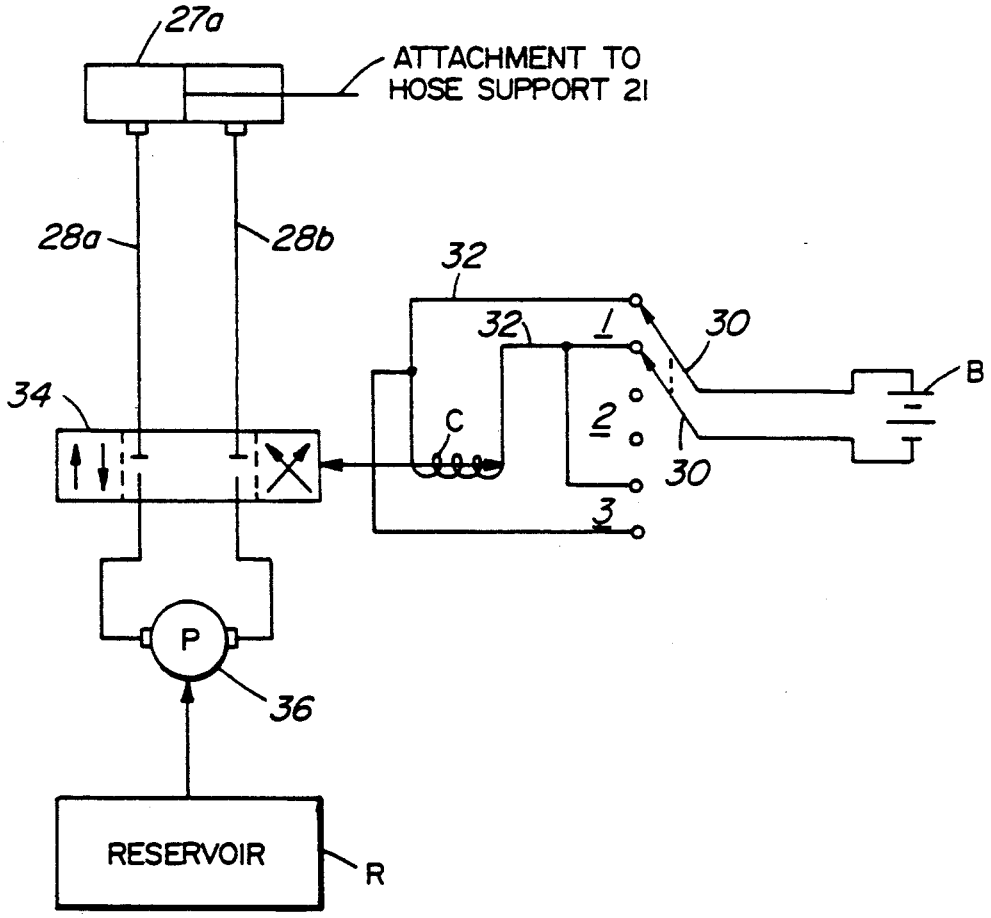
FIG. 6 illustrates an embodiment of the hydraulic power assisted support arm maneuvering system in schematic format.

FIG. 6 illustrates the hydraulic power assisted support arm maneuvering system in schematic format.

Figure 5:
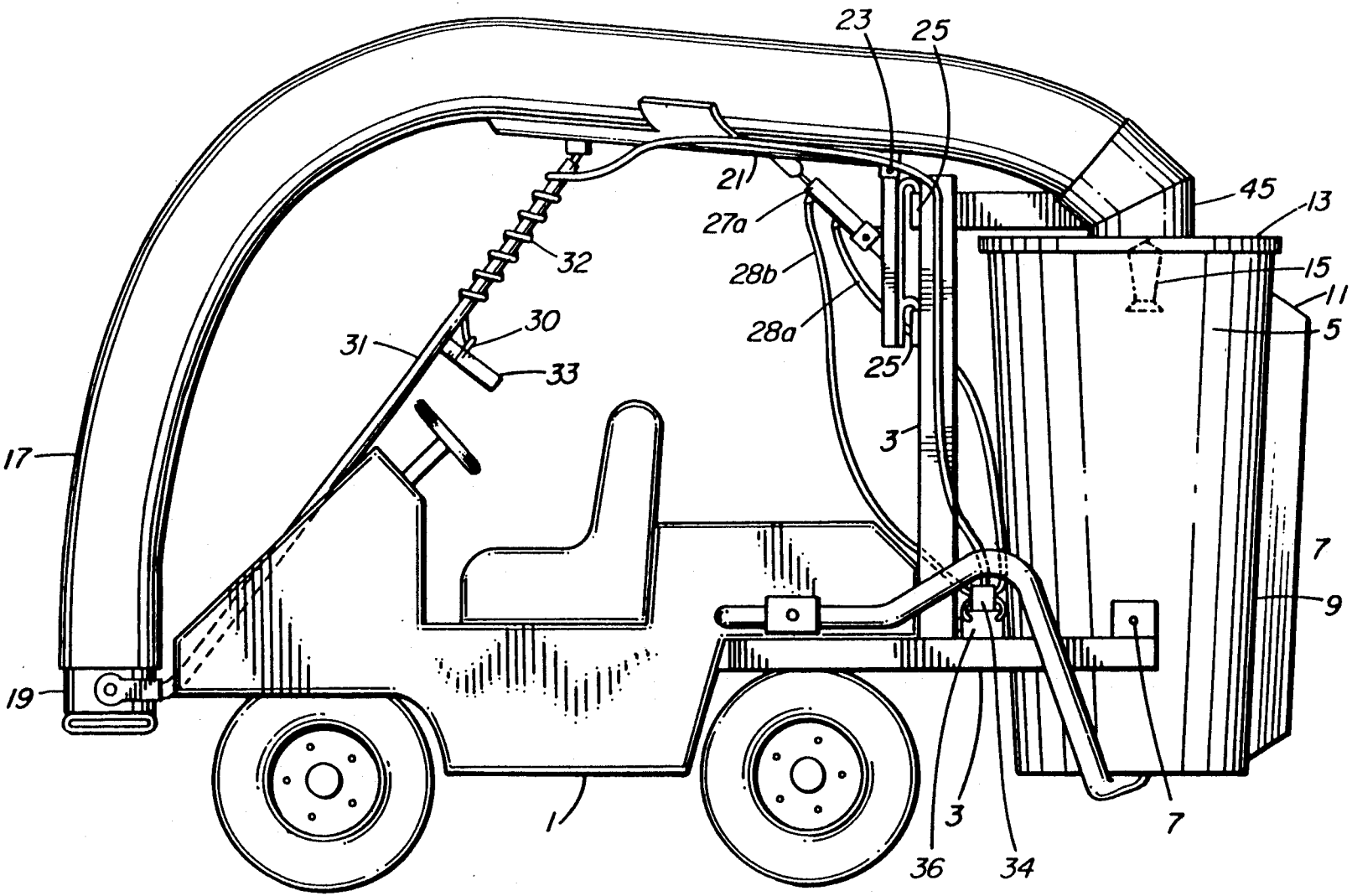
FIG. 5 is a side elevation view of an alternative embodiment of a mobile vacuum trash collecting device in accordance with the present invention.

In operation, with reference to FIGS. 5 and 6, in order to lift the support arm 21, and thereby also hose 17 and inlet 19, the operator pushes the switch 30 on handle 33 to a first position for causing current to flow through energizing coil C in a first direction. The switch 33 is preferably a double pole triple throw switch for connecting a battery B to one of either a first pair of terminals for causing current to flow in the aforementioned first direction, a second pair of terminals connected to an open circuit, or a third pair of terminals for causing current to flow through the coil C in a direction opposite to the first direction.

In response to current flowing through the coil C in the first direction, solenoid valve 34 is pulled to the right in FIG. 6 such that oil flows into the cylinder 27*a* through hose 28*a* and out of the cylinder through hose 28*b* for pushing the piston out relative to the cylinder 27*a*, thereby raising the support arm 21.

Alternatively, in response to current flowing in the aforementioned second direction through coil C, the solenoid valve 34 is pushed to the left for causing fluid to flow from pump 36 into the hydraulic cylinder 27*a* via hose 28*b*, and out of cylinder 27*a* via hose 28*a*, thereby pulling the piston into the hydraulic cylinder 27*a* for lowering the support arm 21.

The oil pumped via hydraulic pump 36, as well as the hydrostatic traction pump (not shown) is received from an oil reservoir R, in a well known manner.

The hydraulic pump 36 can also be used to drive a vacuum blower disposed within the bin 5 for drawing debris into the inlet 19 through hose 17 and therefrom into the bin.

In summary, an operator of the improved mobile vacuum trash collector of the present invention is able to maneuver the hose 17 and inlet 19 laterally by swinging the telescoping arm 31 to the left or right relative to the operator. The hose may be raised or lowered by simply pushing the three-position switch 30 to one of either the forward or reverse positions. The switch 30 is normally spring-biased to a centre position in which no current flows through the coil C and the solenoid 34 returns to a centre position (as shown in FIG. 6) such that no oil flows through the hoses 28*a* and 28*b*, thereby maintaining the position of the hydraulic cylinder and the support arm 21 at a predetermined orientation.

A person understanding the present invention as defined by the supplementary disclosure may conceive of other embodiments or variations therein. All such embodiments or variations are believed to be within the sphere and scope of the claims supported by the supplementary disclosure appended hereto.

I claim:

1. A vehicular vacuum trash collector comprising a motorized cart for carrying a human operator, a bin connected to the rear of said cart, a hose connected at one end to said bin and having an inlet at the other end thereof, means for maneuvering said hose and nozzle independently of said cart, means for emptying said bin, a vacuum blower disposed within and at an opposite end of said bin from said hose for drawing debris via suction into said nozzle, through said hose and into said bin, further including air permeable means within said bin intermediate said one end and said vacuum blower for trapping said debris within the bin, said vacuum blower further comprising at least one fan for drawing airborne debris into said bin, said debris being trapped in said air permeable means.

2. A vacuum trash collector as defined in claim 1 wherein said air permeable means comprises an air permeable bag for trapping said debris within the bin.

3. A vacuum trash collector as defined in claim 2 wherein said vacuum blower is comprised of a plurality of rotating fans.

4. A vacuum trash collector as defined in claim 3 wherein said plurality of fans are centrifugal fans.

5. A vacuum trash collector as defined in claim 2, 3 or 4, wherein said vacuum blower comprises:

(a) an upper rotating fan for drawing airborne debris downwardly into said bin, said debris being trapped in said air permeable bag, and drawing air centrifugally outwardly toward the periphery thereof;

(b) a stationary air guide having a plurality of straight fins for directing said outwardly drawing air axially inward toward the centre thereof, and;

(c) a lower rotating fan for drawing said inwardly directed air downwardly and centrifugally outward toward an exhaust port, wherein each of said upper rotating fan and lower rotating fan includes a plurality of curved fins disposed in a nautilus pattern.

6. A vacuum trash collector as defined in claim 2, 3 or 4 wherein said air permeable bag is comprised of jute.

7. A vacuum trash collector as defined in claim 2, 3 or 4 wherein said air permeable bag is comprised of porous plastic material.

8. A vacuum trash collector as defined in claim 2, 3 or 4 wherein said air permeable bag is comprised of fibrous polypropylene.

9. A vacuum trash collector as defined in claim 3 wherein said plurality of fans are disposed on a rotating shaft driven by a motor.

10. A vacuum trash collector as defined in claim 1, 2 or 3, further including a lid for said bin, said hose being connected to said bin through said lid.

11. A vacuum trash collector as defined in claim 1, 2 or 3, wherein said vacuum blower comprises a pair of centrifugal fans and a stationary air guide disposed therebetween.

12. A vacuum trash collector as defined in claim 1, 2 or 3 further including an exhaust port in said bin for venting air from said bin.

13. A vacuum trash collector as defined in claim 1, 2 or 3 further including an exhaust port in said bin for venting air from the bin, and means connected to said exhaust port for filtering airborne dust particles vented from said bin.

14. A vacuum trash collector as defined in claim 2 wherein said at least one fan is disposed on a rotating shaft driven by a motor.

15. A vacuum system as defined in claim 1, wherein said vacuum blower is connected to said bin at the center of gravity of said trash collector, thereby contributing to the stability of said cart.

16. A mobile vacuum trash collector comprising: a vehicle, a frame connected to said vehicle, a bin mounted on said frame, a hose connected to one end of said bin, said hose having an inlet at an opposite end thereof, and vacuum means within and at an opposite end of said bin from said hose, for sucking debris into said inlet, through said hose and into said bin, wherein a suction path is provided from said one end to said opposite end of the bin, further including a rigid support arm pivoted to said frame, for carrying said hose, means for resiliently supporting said hose carried by the arm, means for providing vertical and horizontal swinging movement to said hose carried by said arm, and means for adjusting the vertical equilibrium position of said arm.

17. A mobile vacuum trash collector as defined in claim 16, further including an air permeable bag disposed within said bin, for trapping airborne debris but allowing air to pass therethrough.

18. A mobile vacuum trash collector as defined in claim 17, wherein said vacuum means is comprised of at least one rotating fan.

19. A mobile vacuum trash collector as defined in claim 16, 17 or 18 wherein said vacuum means is comprised of at least one centrifugal fan.

20. A mobile vacuum trash collector as defined in claim 16, 17 or 18 wherein said vacuum means is comprised of a pair of centrifugal fans and a stationary airguide disposed therebetween.

21. A mobile vacuum trash collector as defined in claim 16, 17 or 18 wherein said bin is pivotally connected to said frame for tilting between a first trash receiving position and a second trash emptying position.

22. A mobile vacuum trash collector as defined in claim 16 17 or 18 further including a lid removably connected to said bin and immovably mounted to said frame, said bin being mounted in a slotted pivot to said frame such that in the event said lid and bin are disconnected, said bin drops under the influence of gravity, within said slotted pivot, to a position clear of said lid, for tilting between an upright trash receiving position and a tilted trash emptying position.

23. A mobile vacuum trash collector as defined in claim 16, 17 or 18 further including a door disposed in said bin, through which debris may be emptied.

24. A mobile vacuum trash collector as defined in claim 17 or 18 further including means for filtering airborne dust particles carried by said air which have passed through said air permeable bag.

25. A mobile vacuum trash collector as defined in claim 16, 17 or 18 further including means for maneuvering the inlet of the hose around said vehicle.

26. A mobile vacuum trash collector as defined in claim 16, 17 or 18 wherein said vehicle is a motorized tractor.

27. A mobile vacuum trash collector as defined in claim 16, 17 or 18 wherein said vehicle is a motorized golf cart.

28. A mobile vacuum trash collector as defined in claim 16, 17 or 18 further including at least one wheel for supporting said frame from beneath.

29. A mobile vacuum trash collector as defined in claim 16, 17 or 18 further including a pair of wheels for supporting said frame from beneath, and a hitch on said vehicle for connecting said frame to said vehicle, whereby said vehicle is separable from said frame.

30. A mobile vacuum trash collector as defined in claim 16 or 17 wherein said air permeable bag is comprised of one of either jute or a fibrous plastic material.

31. A mobile vacuum trash collector as defined in claim 16, further including means for adjusting the tension of said means for resiliently supporting in order to adjust the vertical position of the hose.

32. A mobile vacuum trash collector comprising: a vehicle, a frame connected to said vehicle, a bin mounted on said frame, a hose connected to one end of said bin, said hose having an inlet at an opposite end thereof, and vacuum means within and at an opposite end of said bin from said hose, for sucking debris into said inlet, through said hose and into said bin, wherein a suction path is provided from said one end to said opposite end of the bin, and wherein said bin is pivotally connected to said frame, and further including a lid connected to said hose and removably connected to said bin, whereby said lid and bin may be separated for tilting said bin between a first trash receiving position and a second trash emptying position.

* * * * *